US007997991B2

(12) United States Patent
Kanemaru et al.

(10) Patent No.: US 7,997,991 B2
(45) Date of Patent: Aug. 16, 2011

(54) COSTUME SUIT OF LARGE SIZE ANIMAL

(75) Inventors: Kazuya Kanemaru, Tokyo (JP); Akemi Kozuka, Tokyo (JP)

(73) Assignee: ON-ART Corp., Tokyo (JP)

( * ) Notice: Subject to any disclaimer, the term of this patent is extended or adjusted under 35 U.S.C. 154(b) by 285 days.

(21) Appl. No.: 12/293,962

(22) PCT Filed: Sep. 19, 2007

(86) PCT No.: PCT/JP2007/068122
§ 371 (c)(1),
(2), (4) Date: Sep. 22, 2008

(87) PCT Pub. No.: WO2009/037741
PCT Pub. Date: Mar. 26, 2009

(65) Prior Publication Data

US 2010/0233932 A1 Sep. 16, 2010

(51) Int. Cl.
*A63J 5/00* (2006.01)
*A63H 33/00* (2006.01)

(52) U.S. Cl. ..... 472/84; 472/83; 472/133; 446/26; 446/27; 446/28; 297/181; 280/1.23

(58) Field of Classification Search ..... 446/26–28; 472/83, 84, 133; 297/181; 427/83, 84; 280/1.22, 280/1.23; 2/311
See application file for complete search history.

(56) References Cited

U.S. PATENT DOCUMENTS 395,189 A * 12/1888 Stanton ..... 2/1
695,903 A * 3/1902 Braatz ..... 472/84
1,252,257 A * 1/1918 Fritsche ..... 472/84
1,378,641 A * 5/1921 Williamson ..... 472/84
1,898,587 A * 2/1933 Messmore ..... 472/84
(Continued)

FOREIGN PATENT DOCUMENTS

FR 1 527 095 A 9/1968
(Continued)

OTHER PUBLICATIONS

DINO 1/1 Plan, On-Art Corp., Published Aug. 30, 2007, Accessed Oct. 10, 2007 <http://www.k4.dion.ne.jp/~ on-art/dino/walking/html/siyou.htm>.

*Primary Examiner* — Gene Kim
*Assistant Examiner* — Scott Young
(74) *Attorney, Agent, or Firm* — Sughrue Mion, PLLC

(57) ABSTRACT

A costume suit modeled after a large size animal having a head and mouth section, a neck section, a torso section, a foot section, a tail section, a skeletal part as a whole, and an outer skin part covering the whole is provided. The torso section is communicated with the foot section forming an internal hollow, just enough for an adult to fit at standing position. The hollow includes a frame pack fixed and installed to the skeletal part of the costume suit, in a position of an approximate equilibrium point of the costume suit. In the hollow, a means for manipulating a movement of the head and mouth section and the neck section, and a means for manipulating opening and closing of a mouth of the head and mouth section are equipped. Moreover, the skeletal part of the tail section is composed of a flexible tabular member placed in an internal hollow of the tail section, imitating a skeleton of a tail, and a plurality of foam blocks fixed and placed on the tabular member at certain intervals.

12 Claims, 3 Drawing Sheets

U.S. PATENT DOCUMENTS

| | | | | | |
|---|---|---|---|---|---|
| 2,100,245 | A | * | 11/1937 | Fagan | 446/28 |
| 2,176,936 | A | * | 10/1939 | Sullivan | 472/84 |
| 2,264,214 | A | * | 11/1941 | Lawrence | 446/28 |
| 2,707,102 | A | * | 4/1955 | Wendt | 446/28 |
| 2,938,725 | A | * | 5/1960 | Vanause | 472/84 |
| 3,382,504 | A | * | 5/1968 | Barbosa | 2/80 |
| 4,154,183 | A | * | 5/1979 | Nunez | 2/302 |
| 5,569,131 | A | * | 10/1996 | Giulianelli | 482/77 |

FOREIGN PATENT DOCUMENTS

| | | | | |
|---|---|---|---|---|
| GB | 19222 | A | | 5/1911 |
| JP | 05-033781 | U | | 5/1993 |
| JP | 08-309037 | A | | 11/1996 |
| JP | 3062113 | | * | 6/1999 |
| JP | 3062113 | U | | 6/1999 |
| JP | 2002-052260 | A | | 2/2002 |
| JP | 3109075 | U | | 3/2005 |

* cited by examiner

【Fig. 1】
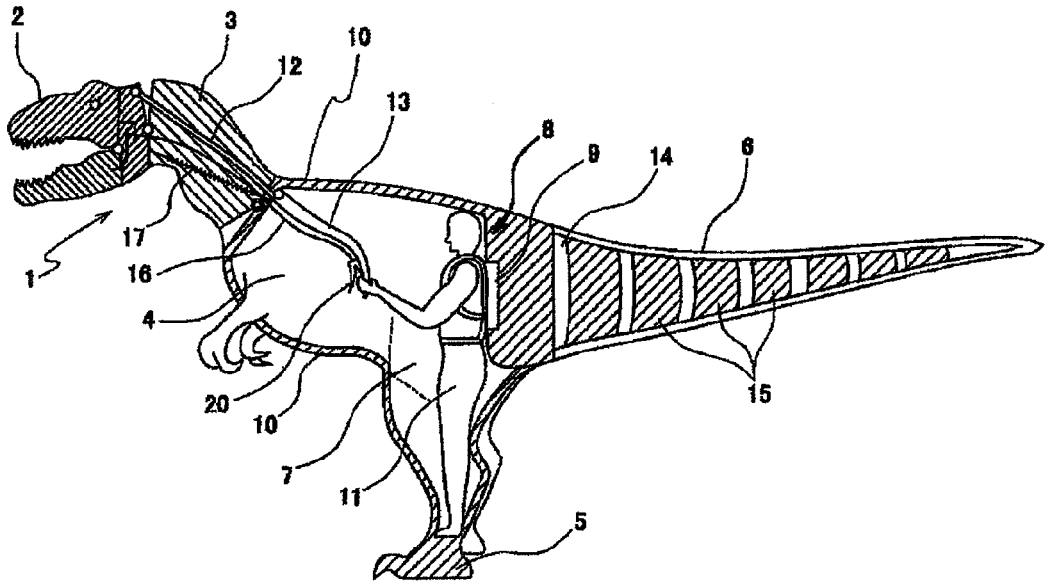

【Fig. 2】
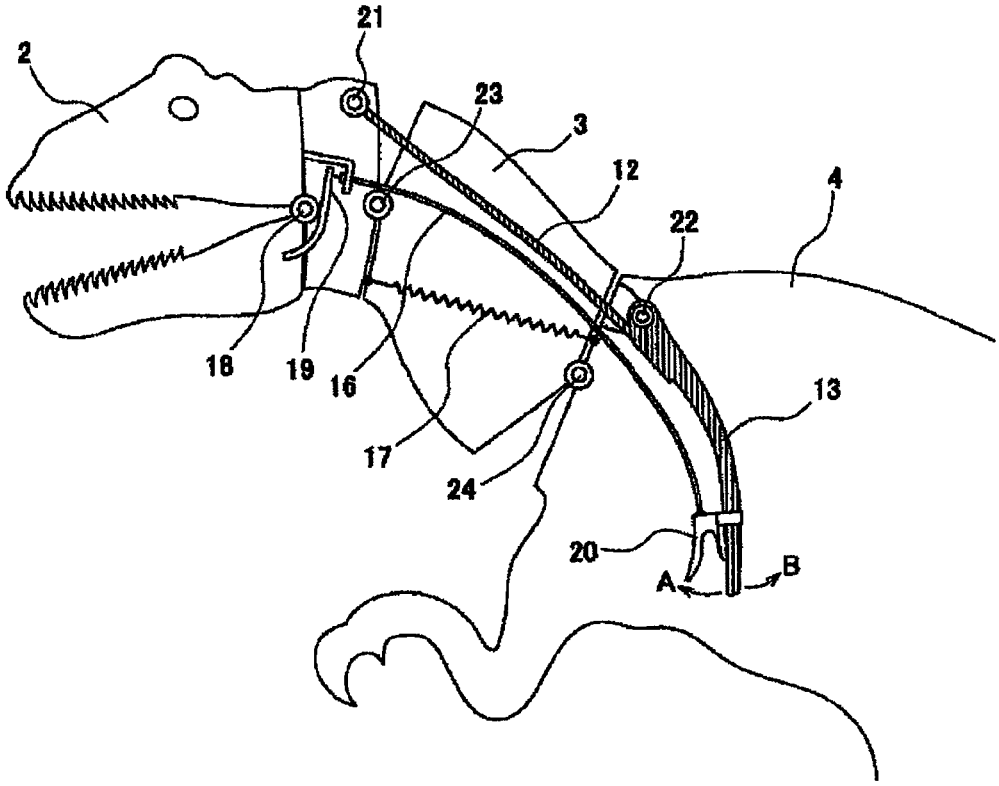

【Fig. 3】
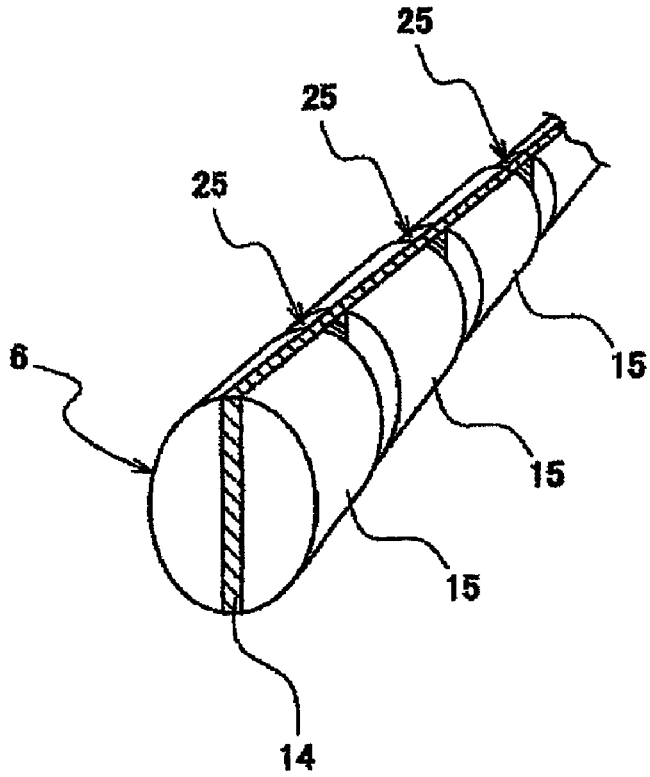

COSTUME SUIT OF LARGE SIZE ANIMAL

TECHNICAL FIELD

The present invention relates to a costume suit modeled after a large size animal (or a costume suit of a large size animal) that makes a realistic movement, and particularly relates to an internal structure thereof.

BACKGROUND ART

A costume suit means a large costume that a person can wear. The costume suit is made of special clothing or material, covers a whole body of the person inside, and is used to transform into an anthropomorphized animal or a fictitious creature, such as a monster. For such a representation, the costume suit is widely used in various events, an entertainment show of an amusement park, and TV program, etc.

A full-scale restoration model of a large size animal such as a dinosaur is often presented to exhibit in various fairs, a museum, and the like. When moving images of a large size animal are needed, realistic movements can be achieved nowadays with computer graphics (CG), which are widely used to create special effects for a movie and the like. Meanwhile, a full-scale costume of a large size animal with realistic movement is sometimes demanded in an amusement park and a theme park, etc. or at a theatrical performance stage.

However, as for a conventional costume suit, for instance, an animal suit imitating a large size animal such as a dinosaur, has been hardly used in a practical sense because its long and large (in front and back, at right and left) shape makes difficult to maintain balance, and it may be fall if it is forcedly moved. Conventionally, for instance, Japanese Patent Laid-Open Publication No. 8-309037 discloses a two-legged ambulatory animal toy equipped with drive mechanism at both sides of the torso. Japanese Patent Laid-Open Publication No. 2002-52260 discloses a manually controlled puppet with an internal hollow, which is moved in various ways by a control lever or other device. Japanese Patent Laid-Open Publication No. 8-309037 discloses an animal suit toy with a plurality of parts to be put on the body. However, as far as known to the inventor, a full-scale costume suit of a large size animal that is able to make a realistic movement has not been disclosed.

DISCLOSURE OF INVENTION

Problems to be Solved by the Invention

Thus, an object of the present invention is to provide a full-scale costume suit of a large size animal that makes or is able to make a realistic movement.

Means for Solving the Problems

In accordance with claim 1 of the invention, a costume suit of a large size animal for making a realistic movement is provided. The costume suit includes a head and mouth section, a neck section, a torso section, a foot section, a tail section, a skeletal part as a whole, and an outer skin part covering the whole. The torso section is communicated with the foot section forming an internal hollow, just enough for an adult to fit at standing position. The hollow includes a frame pack fixed and installed to the skeletal part of the costume suit, in a position of an approximate equilibrium point of the costume suit.

In accordance with claim 2 of the invention, the costume suit of the large size animal of claim 1 further includes a means, equipped in the hollow, for manipulating a movement of the head and mouth section and the neck section.

In accordance with claim 3 of the invention, the costume suit of the large size animal of claim 2 has the means for manipulating a movement of the head and mouth section and the neck section, and the means includes an operation arm (composed of an arm part and a handle) extended from the head and mouth section to the hollow of the torso section and a spring stretched from the neck section to the torso section.

In accordance with claim 4 of the invention, the costume suit of the large size animal of claim 1 further includes a means, equipped in the hollow, for manipulating opening and closing of a mouth of the head and mouth section.

In accordance with claim 5 of the invention, the costume suit of the large size animal of claim 4 has the means for manipulating opening and closing of the mouth of the head and mouth section, and the means includes a wire (including a wire rope) extended from the head and mouth section to the hollow of the torso section and a lever attached to the opposite terminal side of the head and mouth section.

In accordance with claim 6 of the invention, the costume suit of the large size animal of claim 1 has the skeletal part of the tail section that include a flexible tabular member placed in an internal hollow of the tail section, imitating a skeleton of a tail, and a plurality of foam blocks fixed and placed on the tabular member at certain intervals.

In accordance with claim 7 of the invention, the costume suit of the large size animal of claim 1 has the foot section that includes a raised bottom.

In accordance with claim 8 of the invention, the costume suit of the large size animal of claim 1 has the outer skin part of the costume suit that is made of a combination of a thin elastic rubber sheet and a foam.

In accordance with claim 9 of the invention, the costume suit of the large size animal of claim 1 is the costume suit of a large size bipedal animal.

Furthermore, in accordance with claim 10 of the invention, the costume suit of the large size animal of claim 1 is the costume suit of a dinosaur.

The costume suit of the present invention, modeled after a large size animal, has the internal hollow, just enough for an adult to fit inside at standing position, where the frame pack is fixed and installed at the position to maintain the balance of the suit. By wearing the frame pack, the person can move the large size costume suit on a proper balance and safely achieve a realistic movement of the large animal.

BRIEF DESCRIPTION OF THE DRAWINGS

FIG. 1 shows an overview of a costume suit of a bipedal dinosaur and illustrates an internal structure;

FIG. 2 illustrates a connecting relation of a head and mouth section, a neck section, and a torso section of the dinosaur costume suit of FIG. 1; and FIG. 3 illustrates a structure of a skeletal part of a tail section of the dinosaur costume suit of FIG. 1.

BEST MODE FOR CARRYING OUT THE INVENTION

A costume suit of the present invention is a costume suit modeled after a large size animal, containing a head and mouth section, a neck section, a torso section, a foot section, and a tail section, and as a whole, formed with a skeletal part and an outer skin part covering it. An overview of a costume suit of a bipedal dinosaur 1 is shown in FIG. 1 as an example of a large size animal of the present invention, which has a head and mouth section 2, a neck section 3, a torso section 4, a foot section 5, and a tail section 6 (details of FIG. 1 are described in an embodiment). The large size animal may be an existent animal, fictitious animals, such as various characters and a monster, or an animal whose existence is scientifically supported, such as a dinosaur. Furthermore, it may be four-footed or two-footed, and it also includes a large size bird (as for a bird, a blade part should be included in the torso section). In the present invention, the large size animal is preferably a bipedal animal or a four-footed animal being able to walk with two feet. Especially, the costume suit imitating one of various kinds of dinosaurs is preferred.

Although details vary depending on its shape, the costume suit of the present invention is essentially composed of the skeletal part for building up and maintaining the entire body form of the large size animal, and the outer skin part representing surfaces, such as cutis, covering the body. Furthermore, the torso section needs to be in communication with the foot section and have an internal hollow, just enough for an adult to fit inside at standing position. Meanwhile, an internal of the other sections may be either empty or filled with lightweight material, such as polystyrene foam. Though a composition of the skeletal part is not necessarily specified, the composition and a construction material need to be as light as possible with sufficient strength to build up and maintain the entire body form.

For example, a construction material of the skeletal part may be a natural material, such as a wood and a bamboo, plastics, such as a polyethylene and a polyvinyl chloride, a foam material, such as a polystyrene and a polyurethane, FRP which uses glass fiber, a carbon fiber, etc. as a reinforcing material, or a lightweight metal, such as aluminum. As a construction material of the outer skin part, a stretchable material is preferred; various fabrics, paper, various films, various rubbers, or various foam materials may be used. In the present invention, a combination of a thin elastic rubber sheet and a foam material, such as a urethane is especially preferable as a construction material of the outer skin part. A costume suit is more preferable as it weighs lighter, and a construction material of the outer skin part is most connected to the weight thereof. In the present invention, the combination of a thin rubber sheet and a foam material, such as a urethane is especially preferable as a construction material of the outer skin part since it can remarkably reduce the entire body weight.

For a specific example, an extremely lightweight synthetic sheet can be made by laminating and pasting a foam material, such as a urethane, to a thin rubber latex sheet. When such a synthetic sheet is used for the outer skin part, an allosaurus costume suit with about 6 meters long, which ordinarily weighs about 60 kg, may weigh only 24-25 kg. Then, when this is carried on the back with frame pack, a weight on carrier's shoulders is as light as about 16-17 kg.

The costume suit of the present invention has the torso section communicated with the foot section forming an internal hollow, just enough for an adult to fit inside at standing position. The person enters into the hollow and carries the frame pack, which is fixed and installed there. The frame pack should be fixed at an approximate equilibrium point of the costume suit i.e., a point equivalent to a fulcrum point when the whole costume suit is assumed as a carrying pole, and at an adequate position of a member forming the skeletal part of the costume suit. The frame pack takes the weight of the costume suit. Since the frame pack is placed at the approximate equilibrium point of the costume suit, the entire weight of the costume suit is evenly loaded on the frame pack, and the person who carries it on the back is able to perform a realistic movement of the large animal, to front, rear, right, and left, stably and safely.

As described above, in the present invention, the approximate equilibrium point of the costume suit means a point equivalent to a fulcrum point when the whole costume suit is assumed as a carrying pole (including above or below neighboring region of the fulcrum point). Furthermore, though a frame pack in general is a carrying device to carry a baggage on one's back, strapped or placed with shoulder straps or belts, in the present invention, neither its shape, material nor a fixing method to the skeletal part is restricted in any way, provided that the person in the hollow is able to carry the costume suit on the back with the frame pack.

Since the costume suit of the present invention is formed a simple balance like structure to place the center of mass at shoulders of a person who is in inside and wears the costume suit, it is easy to maintain the overall balance. Hence, one can wear and use the costume suits that is, for example, five to 10 times larger than a conventional suit.

In the hollow (hollow where a person is in and stands straight) of the costume suit of the present invention, a means for manipulating a movement of the head and mouth section and the neck section and a means for manipulating opening and closing of a mouth of the head and mouth section may be installed. By moving the head and mouth section and the neck section and/or the mouth along with a movement of the whole costume suit, a more realistic motion of a large size animal is achievable.

For the means for manipulating a movement of the head and mouth section and the neck section, a composition of an operation arm (composed of an arm part and a handle) extended from the head and mouth section to the hollow of the torso section (within the reach of a hand of the person) and a spring stretched from the neck section to the torso section is preferred. Specifically, a means as shown in FIG. 2, for example, is preferred. In FIG. 2, the arm part 12 of the operation arm is a rod or a pipe of metal, such as aluminum, or a plastic etc. A tip of the arm is locked to the head and mouth section rotatable by a locking point 21. The handle 13 is attached to the other end, and it is locked to the torso section rotatable by a pivot 22. The head and mouth section 2 and the neck section 3, and the neck section 3 and the torso section 4 are connected by a hinge 23 and a hinge 24, respectively, allowing an up-and-down motion.

As mentioned above, the head and mouth section, the neck section, and the torso section are connected at deformable virtual (nearly-) parallelogram vertices consisting of 21, 22, 23, and 24. Furthermore, the spring 17 is stretched between the neck section and the torso section. The locking points of the spring 17 are not particularly defined, provided that the spring is stretched between the neck section and the torso section. However, the spring needs to intersect a lower hem of the virtual parallelogram, 23 to 24. Although FIG. 2 shows only one spring 17, it is preferable to stretch two springs on both sides of the operation arm (the obverse side and reverse side on the drawing).

When the means for manipulating a movement of the head and mouth section and the neck section is configured as described above, the neck section is raised as the handle is moved to the direction of A, and the neck section is lowered as the handle is moved to the direction of B in FIG. 2. In doing so, the head and mouth section is kept in a forward directed position since the parallelogram is maintained. Therefore, a realistic movement of an animal is achievable. Furthermore, the spring stretched intersecting the lower hem of the parallelogram makes a movement of the head and mouth section and the neck section smooth, and handle operation becomes extremely easy.

In the present invention, for the means for manipulating opening and closing of the mouth of the head and mouth section, a composition of a wire (including a wire rope) extended from the head and mouth section to the hollow of the torso section (within the reach of a hand of the person) and a lever attached to the opposite terminal side of the head and mouth section is preferred. Specifically, for example, the manipulating means including the wire and the lever used for the rim brake of a bicycle as shown in FIG. 2 is preferred. In FIG. 2, the wire 16 is generally covered with a plastic sheath. 20 is the lever. An opposite terminal side of the wire to the lever is connected with a movable piece 19, and the movable piece 19 is locked at a lower jaw of the head and mouth section 2. An upper-jaw and the lower jaw of the head and mouth section 2 are connected, openable and closable, by a hinge 18. When the lever 20 is not pulled, the lower jaw is in free position (the mouth is opened). When the person in the hollow operates the lever 20, the movable piece 19 makes the lower jaw move up and down through a movement of a wire, and that makes the mouth open and close.

In the present invention, it is preferred that a skeletal part of the tail section is composed of a flexible tabular member placed in an internal hollow of the tail section, imitating a skeleton of a tail, and a plurality of foam blocks fixed and placed on the tabular member at certain intervals. By composing the skeletal part of the tail section in this way, further realistic movement is enabled. For the flexible tabular member, for example, a tabular member of plastic or rubber is used. These are equivalent to a skeleton of a tail of the large animal, and they are roughly placed along the centerline of an internal hollow of the tail section. For example, in the case of a dinosaur tail, the tabular member gets gradually narrower (or smaller) from a base to an end of the tail.

On the above-mentioned tabular member, a plurality of, for instance, polystyrene foam blocks are fixed and placed at certain intervals. A method for placing and fixing, for example, may be skewering the center of the blocks with the tabular member. Alternatively, as shown in FIG. 3, it may be pasting blocks 15, which are semiellipse at cross section, on both sides of a tabular member 14. In FIG. 3, 25*s* represent gaps between the blocks. In either case, the entire tabular member and the blocks are covered with the material of an outer skin part to form the tail section. Although the number of the blocks is arbitrary, sufficient spaces between the blocks are required so that each block is able to move freely accompanied with a movement of the flexible tabular member, without obstructing each other. Although the shape of a block is not particularly restricted, a circular or elliptical cross-section may be generally suitable. For example, in the case of the tail of a dinosaur, gradually smaller blocks should be placed from the base to the end of the tail, in an adequate numbers.

In the costume suit of the present invention, the feature of the structure of the tail section, coupled with the frame pack, which is fixed and installed in the hollow of the torso section and at the approximate equilibrium point of the costume suit, enables to stably replicate a realistic movement of the large size animal.

Moreover, it is preferred that the foot section of the costume suit of the present invention is composed with a raised bottom. By constructing such a foot section, further realistic movement and form of a large animal are achievable.

When the person enters inside and operates the costume suit of the present invention as a practical matter, the person may operate independently by looking at monitor images of a video camera, which is installed in an adequate position of the costume suit, or may operate by following a direction of an outside conductor via radio communication.

Embodiment

An embodiment of the present invention is now described with reference to the drawings. FIG. 1 shows an overview of a costume suit of a biped dinosaur 1 as an example of a large size animal, which has a head and mouth section 2, a neck section 3, a torso section 4, a foot section 5, and a tail section 6. FIG. 1 is drawn to illustrate an internal structure for description of the dinosaur costume suit. An interior of the torso section 4 and the foot section 5 of the dinosaur 1 forms a hollow 7, just enough for an adult to fit at standing position. In the hollow 7, a frame pack 9 is fixed and installed in a position 8, where is an approximate equilibrium point of the costume suit. The foot section 5 has a raised bottom. In FIG. 1, a skeletal part of the costume suit is omitted except for some portions. Moreover, a material of an outer skin part 10 is elastic and is made of a combination of a thin rubber sheet and a foam material.

FIG. 1 shows the way that a person 11, who enters in the hollow 7, carries the frame pack 9 on the back. In the hollow 7, a means for manipulating a movement of the head and mouth section and the neck section of a dinosaur is installed. The mean is composed of an operation arm (composed of an arm part 12 and a handle 13) extended from the head and mouth section to the hollow of the torso section (within the reach of a hand of the person) and a spring 17 stretched between the neck section and the torso section. Details of the composition and an effect of such a means are as stated in the description of FIG. 2.

Moreover, in the hollow 7, a means for manipulating opening and closing of a mouth of the head and mouth section is installed. The mean is composed of a wire 16 extended from the head and mouth section to the hollow of the torso section (within the reach of a hand of the person) and a lever 20 attached to the opposite terminal side of the head and mouth section. Details of the composition and an effect of such a means are also as stated in the description of FIG. 2. The person 11 in the hollow 7 is able to make an up-and-down movement of the head and mouth section 2 and neck section 3, and open and close the mouth freely and easily by operating the handle 13 of the operation arm and the lever 20 of the wire.

In FIG. 1, the skeletal part of the tail section 6 is composed of a tabular member 14, which is made of flexible plastics, such as polyethylene and vinyl chloride, placed roughly in the center of an internal hollow of the tail section, and a plurality of blocks 15, which are made of foam, such as polystyrene, fixed and placed on the tabular member 14 at certain intervals. By taking such composition, a natural tail-like motion is achievable without an additional operation by a person.

A dinosaur costume suit composed as described above was about 6 meters long. The entire weight was about 24 kg, and a weight load on the frame pack of the person in inside was only about 17 kg. The costume suit was very stable, and realistic motions appropriate for a dinosaur have been easily achieved.

INDUSTRIAL APPLICABILITY

The costume suit of the present invention has a simple balance-like internal structure that places the center of mass at back of a person who wears and operates the costume suit. Accordingly, the person is able to wear and operate a costume suit far larger than a human body, which is conventionally almost impossible to wear and operate by oneself because of the risk of fall. Therefore, the costume suit of the present invention can be widely used, because of its realistic movements, in a theatrical performance and for a special effects shoot of a movie as well as for an entertainment show in an amusement park, a theme park, a TV program, and the like.

The invention claimed is:

1. A costume suit of a large size animal for making a realistic movement thereof comprising: a head and mouth section; a neck section; a torso section; a foot section; a tail section; a skeletal part as a whole; and an outer skin part covering the whole, wherein the torso section is communicated with the foot section forming an internal hollow, just enough for an adult to fit at standing position; and the hollow includes a frame pack fixed and installed to the skeletal part of the costume suit, in a position of an approximate equilibrium point of the costume suit, wherein the approximate equilibrium point of the costume suit is a fulcrum point where the entire weight of the costume suit is evenly loaded on the frame pack.

2. The costume suit of the large size animal according to claim 1, comprising means, equipped in the hollow, for manipulating a movement of the head and mouth section and the neck section.

3. The costume suit of the large size animal according to claim 2, wherein the means for manipulating a movement of the head and mouth section and the neck section comprises an operation arm extended from the head and mouth section to the hollow of the torso section, and a spring stretched from the neck section to the torso section.

4. The costume suit of the large size animal according to claim 1, comprising means, equipped in the hollow, for manipulating opening and closing of a mouth of the head and mouth section.

5. The costume suit of the large size animal according to claim 4, wherein the means for manipulating opening and closing of the mouth of the head and mouth section comprises a wire extended from the head and mouth section to the hollow of the torso section and a lever attached to the opposite terminal side of the head and mouth section.

6. The costume suit of the large size animal according to claim 1, wherein the skeletal part of the tail section comprises a flexible tabular member placed in an internal hollow of the tail section, imitating a skeleton of a tail, and a plurality of foam blocks fixed and placed on the tabular member at certain intervals.

7. The costume suit of the large size animal according to claim 1, wherein the foot section comprises a raised bottom.

8. The costume suit of the large size animal according to claim 1, wherein the outer skin part of the costume suit is made of a combination of a thin elastic rubber sheet and a foam material.

9. The costume suit of the large size animal according to claim 1, wherein the large size animal is a bipedal animal.

10. The costume suit of the large size animal according to claim 1, wherein the large size animal is a dinosaur.

11. The costume suit of the large size animal according to claim 1, wherein the head and the mouth section, the neck section and the torso section are connected at virtual parallelogram vertices.

12. The costume suit of the large size animal according to claim 11, wherein the virtual parallelogram is deformable.

* * * * *